United States Patent [19]

O'Cadiz Castaneda

[11] 4,455,270

[45] Jun. 19, 1984

[54] CONSTRUCTION PROCESS INCLUDING SLAB SLIDING SUPPORT AND COMPRISING SIMULTANEOUS WALL ERECTION

[75] Inventor: Rene A. O'Cadiz Castaneda, Hamburgo No. 322-J, Col. Juarez, Mexico, 6 D.F., Mexico

[73] Assignee: Rene Alejandro O'Cadiz-Castaneda, Mexico, Mexico

[21] Appl. No.: 267,491

[22] Filed: May 27, 1981

[30] Foreign Application Priority Data

Dec. 3, 1980 [MX] Mexico ..... 185014

[51] Int. Cl.[3] ..... E04B 11/16

[52] U.S. Cl. ..... 264/33; 264/34

[58] Field of Search ..... 264/31, 33, 34; 249/20, 249/21, 22

[56] References Cited

U.S. PATENT DOCUMENTS 3,355,853 12/1967 Wallace ..... 264/33

*Primary Examiner*—John A. Parrish

*Attorney, Agent, or Firm*—Ladas & Parry

[57] ABSTRACT

The invention provides a construction process permitting slab sliding and support means as well as simultaneous wall-erection, at the time such slab is being raised.

7 Claims, 2 Drawing Figures

CONSTRUCTION PROCESS INCLUDING SLAB SLIDING SUPPORT AND COMPRISING SIMULTANEOUS WALL ERECTION

BACKGROUND OF THE INVENTION

1. Field of the Invention

The present invention is related to the construction field and more in particular it refers to a construction process which may be utilized for the erection of buildings of any nature, wherein, the two essential construction operations are carried out simultaneously from the initiation of the project.

2. Description of the Prior Art

There is a great diversity of construction processes whereby constructions have been carried out with more or less success. It is important, however to point out that the conventional construction processes in first place require the erection or to build up the walls in order to construct or place the slabs over the same in case such slabs have been pre-fabricated.

There is no presently known construction process wherein the wall erection and the raising of the slab or slabs of the building under construction may be erected simultaneously.

It must be set forth that even though there are construction processes on the market related up to a certain point with the present process such as sliding processes, slab raising, slab raising including prefabricated walls, hinged or fastened thereto, the basic difference between any of the procedures previously described is that none carry out the slab raising operation simultaneously with the wall erection as such may have been designed for a determined construction.

SUMMARY OF THE INVENTION

In view of the foregoing, it is an object of the present invention to provide a construction procedure permitting the wall erection simultaneously with the elevation and sliding of the slab forming part of such a construction.

A further object of the present invention is to provide a construction process, readily carried out, which also permits a labor force reduction.

In fact, with the process described hereinafter, a series of manual operations are eliminated with regard to the wall construction, such as the usual laying of bricks, blocks or the cumbersome and time consuming operation to assemble and dismantle the vertical forms or falsework placed on the two surfaces of the contact areas thereof as it is conventional.

A further object of the present invention, is to provide a construction process including slab sliding support means thereof with the simultaneous erection of the walls thereby eliminating the falsework including forms.

Furthermore, through the use of the present process all form assembly for wall erection is eliminated.

The use of the subject process also includes the advantage that its use does not require specialized nor qualified personnel in order to carry the same out.

A still further advantage of the invention is that through the utilization of the present process, wall erection and vertical monolithic elements is permitted.

Furthermore, the present procedure also includes the advantage which permits the slab and horizontal element erection of monolithic nature.

A still further advantage of the present procedure is that through its utilization there is a possibility to perform the work with a cleaniness which was not possible with the prior art procedures.

These and other objects and advantage in part obvious and in part will be made clearly apparent from the following description, taken in conjunction with the drawings, wherein similar reference numbers represent similar parts.

Figure 1:
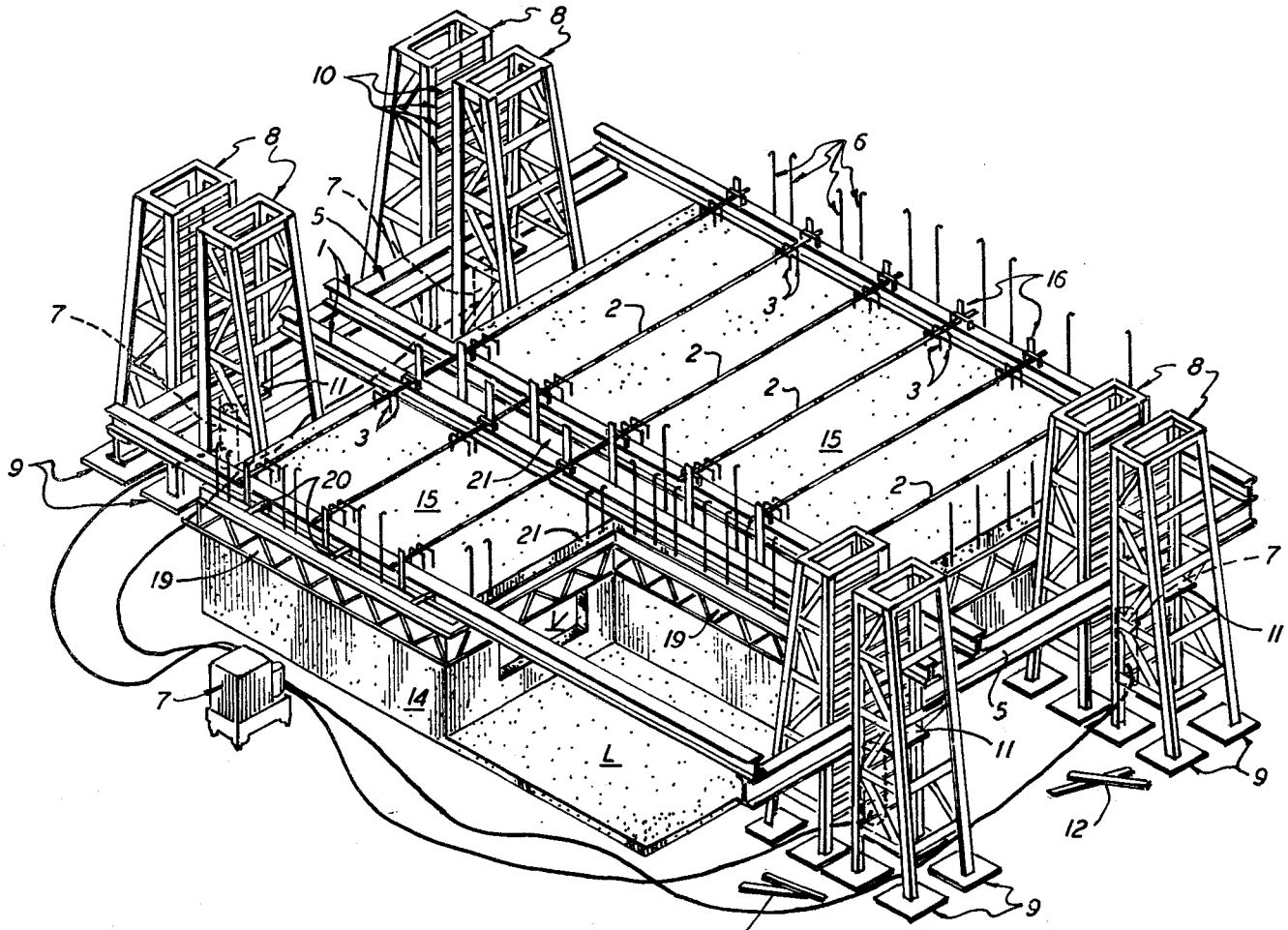
FIG. 1 is a perspective view of the construction procedure including slab sliding and support means with the simultaneous wall erection of the present invention.
Figure 2:
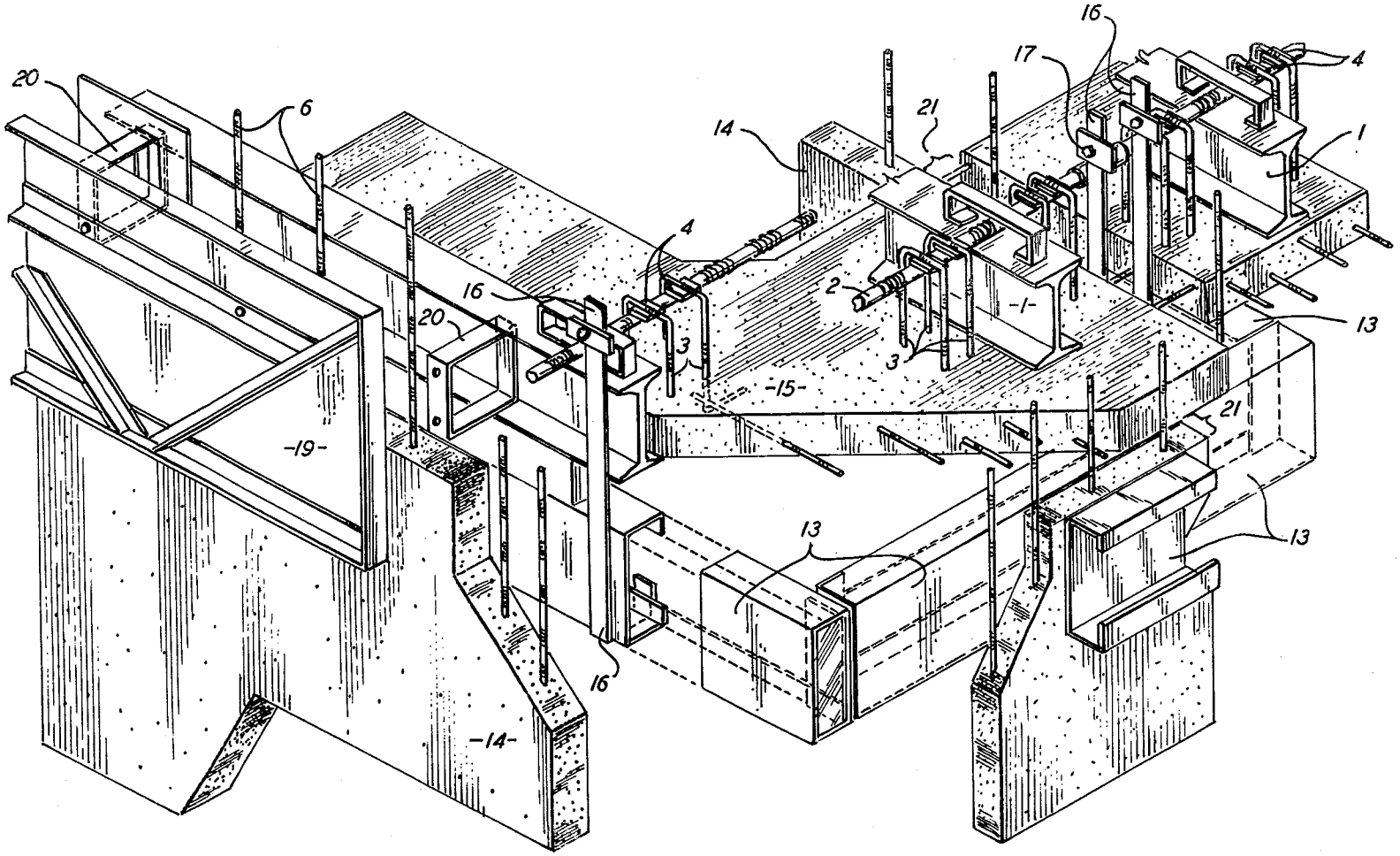
FIG. 2, is a more detailed perspective view ilustrating the construction procedure which is subject to description herein.

The construction procedure including slab sliding and support means with simultaneous wall erection of the present invention basically refers to the construction of a partition or roof 15 which is provided with a series of elements permitting an elevation thereof.

Said means or elements permitting roof 15 to be raised are formed by a series of steel beams 1, also denominated herein as the secondary beams. Said secondary beams are formed by metallic girders of any size or else any truss comprising metallic elements, but may be wooden girders or trusses or preforced concrete girders or any other element, with the only condition that such means have sufficient rigidity or stiffness to support loads imposed thereon. Such secondary beams will be placed at conveniently predetermined distances in accordance with the previously determined estimates, such secondary beams being provided with a series of guides 30, the interior which of houses the metallic pins 2 which are preferentially located perpendicular with regard to the path of the secondary beams 1.

Said pins 2, are preferentially formed by corrugated rods of any diameter, and also may be of any adequate material, with the only condition that such rods include the required stiffness characteristics to support the loads imposed thereon.

Such pins 2, are also inserted into a series of metallic fasteners 3 which are embedded into the partition or roof 15 and which project upwards regarding the same. In order to completely fasten the pins within the fasteners 3, and to provide greater stability to the coupling thereof, steel plate keys 4 having different thickness are provided, in an effort to incorporate the most adequate means.

The mentioned fasteners 3, are hooks anchored into the steel reinforcement of the slab, preferentially corrugated rods of any diameter, but may be formed from any other adequate material only conditioned in that such fasteners be coupled to the pins 2 in order to transfer movement from said pins to the slab, through the mentioned connecting means.

On the other hand, the keys are particularly illustrated as steel plate keys of different thickness, but may be formed from wood or any other material, only conditioned in that such keys establish the connection between the pins 2 and the fasteners 3.

Once the pin insertion operation within the fasteners 3 is carried out and once the stability of said connection is obtained by the keys 4, two steel beams 5, also denominated in the present disclosure main beams are located under said secondary beams 1 which at extreme positions thereof will always protrude as may be convenient, and such beams will provide the load transfer to all the secondary beams 1 supported by such main beams 5, therefore a uniform raising of the secondary beams 1 is obtained and also of the partition or roof 15.

The main metallic trusses or beams of any other material or they may be formed from any other material having the required high resistence characteristics in order to support maximum loads as may be the case, since such main beams will absorb the total weight of the structure.

In order to effect the previously described elevation of the slab, the interposition of a series of supports is required which aside from the fact that such means support the beams 5, furthermore permit the elevating and descending sliding action of the beams and therefore of all the structure.

In order to manufacture such sliding supports, the assembly and erection of metallic towers 8 having a previously determined size and strength is required. In the embodiment previously described, the towers 8 are formed by four surfaces wherein the outermost is of triangular form and is sloped at an angle less than 90° with regard to the floor. The two lateral surfaces, on the other hand, display the form of truncated isosceles triangle forming an angle of precisely 90° with regard to the floor area. The front surface has the form of a right triangle and also forming an angle of 90° with regard to the floor or ground area.

As it is illustrated in the drawing the outermost surface and the two lateral surfaces, are reinforced and stiffened by a series of metallic bars transversely positioned formed by angle and channel steel strips of different sizes, which furthermore serve the purpose of steps as a ladder in order to have the personnel performing the work go up and down thereon.

On the other hand, the internal surface includes as special characteristic thereof its reinforcement and stiffening with series of metallic bars 10, which are placed horizontally parallely through the full height of the tower thereby forming a ladder. It should be mentioned that the distance between the bars 10 is determined by the subsequent stroke of a hydraulic jack 7. Said bars 10 perform a stiffening action on the towers 8 and are mainly used as a support for the plates 11, wherein the jacks acting on the main beams 5 in order to raise the same and therefore raising the complete assembly, are housed.

A metallic plate 9 is positioned on each and every leg of the lowermost part of the towers in order to obtain a better support with regard to the ground.

The erection of the towers 8 shall be carried out in pairs, on both sides of the main beam 5, the internal surfaces of said towers being in line in a manner where such surfaces are opposed one another at a sufficient distance to have the main beam 5 move upward or downward and also positioned in a way whereby there is a relationship between the elevation of the bars 10 parallel regarding the corresponding towers. The raising and descending operations of the main beams 5 are carried out by vertical thrusts produced by manual or hydraulic jacks 7 positioned along and underneath the base of said main beams 5, in the locus where it may be determined by the adequate calculation, where there are lesser stresses in the raising movement supported on the metallic plates 11.

It is evident, that any apparatus permitting elevation and descent of the structure, may be used, namely sprockets, tirfors, tackle blocks, hoists, riggins, sheaves or any other adequate hoisting or lowering apparatus.

The metallic plates 11 are designed in such a manner that they will surpass the space existing between the internal tower surfaces 8, in a way whereby the ends thereof sufficiently penetrate the interior of said towers, supported on the parallel and staggered metallic bars 10 thereby avoiding all sliding movements thereof.

Even though the provisional attachment of the main beams 5, has been illustrated and described particularly with regard to the metallic plates 11 supported on a series of staggered metallic bars 10, it is quite obvious that the provisional attachment may be carried out by the use of different means, the only requirement being that the main beams 5 be totally locked during a certain period and which may again become fixed after another raising stage thereof.

Once the hydraulic jacks 7 have been positioned in the adequate places a raising operation of the structure formed by the main beams 5 will commence which will raise the secondary beams 1 communicating such movement to the pins 2, thereby raising the slab 15 through the clamps 3. The raising movement will stop at the point where the maximum vertical travel is reached, and such will coincide with the positions of the parallel metallic bars 10 forming the two internal surfaces of the towers 8. When such a point is reached, the auxiliary metallic bars 12 which are designed in such a manner which will have the strength previously estimated, and are placed under the bottom flange of the lower beams, perpendicular thereto and over the stepped metallic bars 10 in order to support the structure.

Once this support action is carried out, the hydraulic jacks 7 and the metallic plates 10 will be removed, and the auxiliary metallic bars 12 will perform the work thereof which will be left is said condition for an adequate period.

Once such time has lapsed, the metallic plates 11 are again supported upon the highermost staggared metallic bars 10. The space existing between the metallic plates 11 and the bottom surface of the main beams 5 which are to be subject to another raising stage, is of a preestablished size in accordance with the estimate, and which is sufficient in order to admit the hydraulic jacks 7 without activating the same. When such jacks are activated once more, the vertical thrust will be transfered to the main beams 5 up to the highermost point where the raising effect is to be interrupted tenporarily and will reinitiate its action after determined period of time has lapsed, repeating the operation as many times as required in order to obtain the maximum height sought by the designed construction.

As it has been previously established, the basic outlook of the construction system of the present invention, wherein the construction of the walls is carried out simultaneously with the slab raising operation effected slidingly.

As it has been provided, in order to effect this construction simultaneously, the phrases regarding wall construction will be incorporated into the slab raising operation. In order to erect such walls, it will be necessary to conform the slab 15 to including a serie of six corrugated steel rods of adequate diameter in accordance with the estimates previously effected and will include voids or openings 21, which will run longitudinally regarding such slab whereat a wall 14 is to be erected before any such wall can be built. Furthermore, cement for the perimeter of the slab will not be poured until the external walls 14 are to be erected thereat.

Furthermore, all the vertical reinforcements will be placed within the spaces 21 as well as all the usual or desired fittings which are to be included in the wall interior before pouring the cement mix therefore.

In order to build the walls, two types of slideable traveling forms are required. In order to put the same in place once the concrete slab 15 is finished and in accordance with the slab raising process previously described, such forms are raised up to a height convenient to fix them on all the longitudinal span of the mentioned spaces 21, and are described hereinafter.

A type of traveling form integrated into the system of the invention, consists of sections 13 which are metallic sections having a depth and thickness previously designed which are positioned under the slab 15 and which as it has been mentioned extends parallel to the central axis of the space or void 21, and conforming to the internal surface of the walls 14.

Such sections 13 are metallic plates denominated in the field as "outriggers" which will be used as lateral falsework or scaffolding to pur walls, to the depths, widths and thickness previously estimated. Such elements can be formed from any other material only conditioned to the perfomance as lateral falsework.

In order to conform the exterior surface of the mentioned walls 14, the outriggers or metallic sections 13 previously described will be placed opposite one regarding the other, the reinforced metallic riggers 19 which have a depth equal to the distance existing between the lower part of the outrigger sections 13 and the height of the lower flange of the secondary beam 1. The thickness, of course, will never be greater than the size fixed as a limit in accordance with the enforceable Construction Regulations, for construction joints whereby buildings of any dimension may be erected without inherent technical problems and avoiding the invasion of adjacent properties.

Said reinforced metallic outriggers 19 will be used as lateral terminal falsework and will be formed of metallic, plastic or wooden elements, or made from any other adequate material.

The sliding travelling form conection to the lower part of the slab is carried out as follows:

The outriggers sections 13 are fixed by metallic trusses 16 which are J forms means, and encircle the lower part of the mentioned sections, protruding on the highermost part thereof a distance greater than the height where the metallic pins 2 are found. Exactly as such height, the mentioned metallic trusses 16 are provided with a bore of a convenient diameter, wherein a bolt including a nut therefore as well as a lock washer 17 will be passed thereby fixing the plate 31 which in turn is welded to a metallic sheath 18 which may have a square or circular cross section and is found encircling the metallic pins, 2.

On the other hand, the other sliding travelling form is formed by reinforced riggers 19 which are fixed to the secondary beams 1 when such are parallel thereto by means of rectangular metallic frames 20 having its largest side portion of a size equal to the size of the web the said riggers and the smallest side portion has a size equal to the result of the addition of the wall thickness 14 which is to be built plus the size of the outermost ends of the flange to the core thereof. Said metallic frames 20 are welded to the core of the secondary beams 1, and are bolted to the reinforced riggers 19.

When the reinforced riggers 19 are perpendicular to the secondary beams 1, such are fixed by bolts screwed into the lower flanges of the mentioned beams.

Since the previously described sliding traveling forms have been fixed to the slab 15, such forms are lowered to the lower surface or base of the traveling forms 13 and 19, and are in contact to the basic or foundation slab. Once the above stage has been reached, the operation is then ready for the first construction stage of the internal and exterior walls in order to continue with the construction of the same thereafter at the same time as the elevation of slab 15.

In order to erect the walls by system of the present invention, as the first stage the final anchoring carried out conforming with their final position, of all the vertical stresses which are to be contained in the walls 14, such as rods 6, hydraulic sanitary and electric fittings are set, the concrete will be poured into spaces or openings 21 which had been previously formed for such a purpose in the slab 12, along its periphery and in the zones where the internal walls are to be erected as planned. The concrete casting continues until such pouring reaches a level included between the lowermost margin of the slab 15 and the foundation, and the existing width between the section 13 and the reinforced portions 19, which of course, will be the width of the internal walls 14 as well as the peripherical walls.

Once the previous operation is carried out, a delay period necessary for the initial curing of the first section and in order to obtain the required stiffness in order to be able to continue the process for the construction of the walls 14 by stages, simultaneously with the slab 15 raising operation.

In all the points where the walls contain openings as designed, such as doors, high and low windows, air conditioning grids, etc. will contain metallic stops which will be positioned perpendicularly to the internal surfaces of the traveling forms 13 and 19, and others in the higher parts thereof and parallel thereto in order to limit the area of the opening, so no concrete may penetrate in such area.

Thereby, the slab elevation 15 will be in stages by the operation of manual or hydraulic jacks 7 until the next level immediately above is reached and thereafter waiting again for the period necessary to initially cure the concrete and such an operation will be repeated as many times as necessary until the highest level of the construction as designed is reached.

We must also set forth that before carrying out the final concrete casting, all the necessary reinforcement means will be joined together, that is, the two ends of the rods 6, are joined at their connecting points in order to give the final construction the required strength.

After the above mentioned stages are carried out, the construction procedure of the instant invention is practically complete, nothing that at this point it is only necessary to support the slab 15 with vertical support means until the reinforced concrete obtains the strength for which it was devised, thereafter withdrawing the supports and commencing the construction finishing and termination operations.

In order to disassemble the means which were used in the system of the present invention, the mounting process described hereinbefore is reversed. Upon the disassembly thereof, each of the parts are submitted to careful examination, and thereafter it is determined, after such an examination, if the parts are to be substituted or repaired for the purpose of obtaining satisfactory results upon the future use.

Even though a particularly preferred embodiment of the invention has been described, it is obvious to those having skill in the field may devise several changes and modifications without departing from the spirit and scope of the invention, and therefore the above description and attached drawings are assumedly considered at illustrative and not in a limiting since the spirit and scope thereof is only defined by the following claims.

What I claim is:

1. A process of constructing a building utilizing slab sliding and support means while simultaneously erecting walls, wherein the process includes the steps of constructing roof or flat floor slabs with spaces at any desired location defining the location of internal walls and further spaces defining the location of external walls, providing the flat slabs with connecting means and coupling said connecting means to a series of elevation transmitters, connecting said elevation transmitters to a series of secondary elevation means which in turn are connected to two main elevating means for raising and lowering said slabs, said main elevating means being positioned upon supports adjacent and outside the construction, connecting said main elevating means to an energy source, raising one of said slabs and locating sliding internal and external falsework in registry with said space therebelow, lowering the slab and sliding falsework integrated thereto until the lower edge thereof is in contact with the floor, casting the external and internal walls of a first storey, curing the cast walls to an adequate strength, repeating the foregoing steps for each storey to be constructed until the maximum designed height of the building is reached, joining projecting wall and slab reinforcements, disconnecting the supports after after the concrete for the last storey has been cast and set to impart the designed strength and rigidity to the building and thereafter dismounting non incorporated construction aids.

2. A construction process as claimed in claim 1, wherein clamps are anchored into the slab to provide the connectors.

3. A construction process as claimed in claim 2, wherein said elevation transmitters are corrugated steel bars which cooperate with said clamps.

4. A construction process as claimed in claim 1, wherein the secondary elevating means are beams.

5. A construction process as claimed in claim 4, wherein said main elevating means include a pair of beams positioned below and at opposite ends of the beams constituting the secondary elevating means.

6. A construction process as claimed in claim 5, wherein a series of towers are positioned in spaced pairs to provide the supports for receiving the main elevating means, said pairs of towers being sufficiently spaced to permit the main beams to be raised or lowered therebetween.

7. A construction process as claimed in claim 1, wherein hydraulic jacks are utilized to provide the energy source of the elevating force.

* * * * *